US009595780B2

(12) United States Patent
Hikosaka

(10) Patent No.: US 9,595,780 B2
(45) Date of Patent: Mar. 14, 2017

(54) CONNECTOR, AND CONNECTION MECHANISM OF FLAT CIRCUIT BODY AND CONNECTOR

(71) Applicant: YAZAKI CORPORATION, Tokyo (JP)

(72) Inventor: Tomohiro Hikosaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/176,879

(22) Filed: Jun. 8, 2016

(65) Prior Publication Data

US 2016/0365659 A1 Dec. 15, 2016

(30) Foreign Application Priority Data

Jun. 12, 2015 (JP) ..... 2015-119606

(51) Int. Cl.

| | |
|---|---|
| ***H01R 12/77*** | (2011.01) |
| ***H01R 12/70*** | (2011.01) |
| ***H01R 13/58*** | (2006.01) |
| *H01R 12/58* | (2011.01) |

(52) U.S. Cl.

CPC ..... *H01R 12/777* (2013.01); *H01R 12/707* (2013.01); *H01R 12/7064* (2013.01); *H01R 13/5829* (2013.01); *H01R 12/585* (2013.01); *H01R 12/77* (2013.01); *H01R 12/771* (2013.01)

(58) Field of Classification Search

CPC ..... H01R 12/77; H01R 12/771; H01R 12/585
USPC ..... 439/492, 67, 77, 499, 751, 82
See application file for complete search history.

(56) References Cited

U.S. PATENT DOCUMENTS

2011/0159719 A1* 6/2011 Takahashi ..... H01R 12/79 439/329

FOREIGN PATENT DOCUMENTS

JP 2011-134582 A 7/2011

* cited by examiner

*Primary Examiner* — Abdullah Riyami
*Assistant Examiner* — Justin Kratt
(74) *Attorney, Agent, or Firm* — Kenealy Vaidya LLP

(57) ABSTRACT

A terminal of a connector includes a press-fitting fixation portion which is pressed and fixed into a terminal press-fitting arrangement portion provided in a connector housing. The press-fitting fixation portion includes a pair of protrusion press-fitting portions protruding from both side portions in protruding directions. The protrusion press-fitting portions abut against a pair of first opposed inner wall surfaces of the terminal press-fitting arrangement portion, and each of the protrusion press-fitting portions includes: a first surface gradually separated from one of a pair of second opposed inner wall surfaces opposed to each other in a direction substantially perpendicular to the first opposed inner wall surfaces toward the protruding direction; and a second surface gradually approaching the other of the pair of second opposed inner wall surfaces toward the protruding direction.

4 Claims, 10 Drawing Sheets

CONNECTOR, AND CONNECTION MECHANISM OF FLAT CIRCUIT BODY AND CONNECTOR

CROSS-REFERENCE TO RELATED APPLICATION(S)

This application is based on and claims priority from Japanese Patent Application (Application No. 2015-119606) filed on Jun. 12, 2015, the entire contents of which are incorporated herein by reference.

BACKGROUND

1. Field of the Invention

The present invention relates to a connector connecting an electrode formed in an end portion of a flat circuit body with a terminal in a connector housing, and a connection mechanism of the flat circuit body and the connector.

2. Description of the Related Art

In the related art, a flat circuit body such as a flexible printed circuit (FPC) or a flexible flat cable is connected to a connector by a connection mechanism. In the connection mechanism of the flat circuit body and the connector, an end portion of the flat circuit body is inserted into a connector housing of the connector while sliding thereon, so that electrodes formed in the end portion of the flat circuit body can be connected to terminals in the connector housing.

For example, JP-A-2011-134582 discloses a connection mechanism of a flat circuit body and a connector, in which an end portion of the flat circuit body is inserted into a connector housing of the connector while sliding thereon, so that electrodes formed in a lower surface of the end portion can be connected to terminals each including an elastic contact piece portion and a mounting portion. The elastic contact piece portion serves as a part that extends like a slope from a press-fitting fixation portion toward a corresponding electrode so as to elastically contact with the electrode. The press-fitting fixation portion is fixed to a corresponding terminal press-fitting arrangement portion in the connector housing by press fitting. On the opposite side to the elastic contact piece portion with respect to the press-fitting fixation portion, the mounting portion serves as a part that is mounted on a destination to which the connector housing is fixed.

SUMMARY

However, as shown in FIGS. 10A and 10B, when a flat circuit body 400 is inserted into a connector housing 500 before each terminal 300 is mounted on a mounting destination, a load is applied to an elastic contact portion 310 downward below an end portion of the flat circuit body 400. Thus, there is a fear that a mounting portion 330 may be inclined upward with a press-fitting fixation portion 320 as a fulcrum. It is therefore difficult to mount the terminal 300. As a result, there is a fear that stability in connection between the terminal 300 and the mounting destination of the terminal may deteriorate.

In order to solve the foregoing problem, it can be considered that a vertical clearance between the terminal press-fitting arrangement portion and the terminal is suppressed to be small enough to suppress vertical looseness of the terminal to be small. However, when the terminal is pressed into the terminal press-fitting arrangement portion, the terminal is apt to interfere with the inner wall surfaces of the terminal press-fitting arrangement portion. As a result, there is a problem that it is difficult to press the terminal into the connector housing.

The present invention has been developed in consideration of the aforementioned situation. An object of the invention is to provide a connector capable of suppressing looseness of each terminal to be small in directions perpendicular to each other inside a connector housing to thereby improve stability in connection between the terminal and a mounting destination of the terminal, and capable of preventing difficulty in pressing the terminal into the connector housing, and a connection mechanism of a flat circuit body and the connector.

In a first aspect of the present invention, there is provided a connector including: a connector housing which includes a terminal press-fitting arrangement portion and to which a flat circuit body including an electrode formed in an end portion thereof is allowed to be slidably inserted; and a terminal which is provided in the connector housing and which is connected to the electrode when the end portion is inserted into the connector housing, wherein the terminal includes: a press-fitting fixation portion which is pressed and fixed into the terminal press-fitting arrangement portion; an elastic contact piece portion which extends like a slope from the press-fitting fixation portion toward the electrode so as to serve as a part elastically contacting with the electrode; and a mounting portion which is provided on an opposite side to the elastic contact piece portion with respect to the press-fitting fixation portion so as to serve as a part which is mountable on a fixing destination of the connector housing, wherein the press-fitting fixation portion includes a pair of protrusion press-fitting portions which protrude in protruding directions from both side portions of a fixation body portion which continuously extend between the elastic contact piece portion and the mounting portion along a press-fitting direction, wherein the terminal press-fitting arrangement portion includes: a pair of first opposed inner wall surfaces which are opposed to each other at lateral sides of the fixation body portion in a state where the press-fitting fixation portion is pressed and fixed; and a pair of second opposed inner wall surfaces which are opposed to each other in a direction substantially perpendicular to the first opposed inner wall surfaces, and wherein in a state where the protrusion press-fitting portions are pressed and fixed into the terminal press-fitting arrangement portion, the protrusion press-fitting portions protrude from the both side portions of the fixation body portion toward the first opposed inner wall surfaces, respectively, so as to abut against the pair of first opposed inner wall surfaces, and each of the protrusion press-fitting portions includes a first surface gradually separated from one of the pair of second opposed inner wall surfaces toward the protruding direction, and a second surface gradually approaching the other of the pair of second opposed inner wall surfaces toward the protruding direction.

In a second aspect of the present invention, there is provided a connection mechanism of a flat circuit body and a connector, the connection mechanism including: a flat circuit body including an electrode formed in an end portion thereof; and a connector including: a connector housing which includes a terminal press-fitting arrangement portion and to which the flat circuit body is allowed to be slidably inserted; and a terminal which is provided in the connector housing and which is connected to the electrode when the end portion is inserted into the connector housing, wherein the terminal includes: a press-fitting fixation portion which is pressed and fixed into the terminal press-fitting arrangement portion; an elastic contact piece portion which extends like a slope from the press-fitting fixation portion toward the electrode so as to serve as a part elastically contacting with the electrode; and a mounting portion which is provided on an opposite side to the elastic contact piece portion with respect to the press-fitting fixation portion so as to serve as a part which is mountable on a fixing destination of the connector housing, wherein the press-fitting fixation portion includes a pair of protrusion press-fitting portions which protrude in protruding directions from both side portions of a fixation body portion which continuously extend between the elastic contact piece portion and the mounting portion along a press-fitting direction, wherein the terminal press-fitting arrangement portion includes: a pair of first opposed inner wall surfaces which are opposed to each other at lateral sides of the fixation body portion in a state where the press-fitting fixation portion is pressed and fixed; and a pair of second opposed inner wall surfaces which are opposed to each other in a direction substantially perpendicular to the first opposed inner wall surfaces, and wherein in a state where the protrusion press-fitting portions are pressed and fixed into the terminal press-fitting arrangement portion, the protrusion press-fitting portions protrude from the both side portions of the fixation body portion toward the first opposed inner wall surfaces, respectively, so as to abut against the pair of first opposed inner wall surfaces, and each of the protrusion press-fitting portions includes a first surface gradually separated from one of the pair of second opposed inner wall surfaces toward the protruding direction, and a second surface gradually approaching the other of the pair of second opposed inner wall surfaces toward the protruding direction.

In a third aspect of the present invention, there is provided the connection mechanism of a flat circuit body and a connector according to the second aspect, wherein the press-fitting fixation portion has a substantially U-shaped cross-sectional shape at a part where the pair of protrusion press-fitting portions are formed.

In a fourth aspect of the present invention, there is provided the connection mechanism of a flat circuit body and a connector according to the second or third aspect, wherein the connector housing includes at least a pair of rotation preventing ribs which are fixed to a fixing destination of the connector housing by a fixing fixture, which protrude in opposite directions to each other with respect to the fixing fixture placed therebetween, and which form part of a bottom surface of the connector housing.

According to the connector according to the first aspect of the invention, and according to the connection mechanism of a flat circuit body and a connector according to the second aspect, in the press-fitting fixation portion, the pair of protrusion press-fitting portions protrude laterally in opposite directions to each other so as to abut against the first opposed inner wall surfaces respectively. At the same time, the part between the pair of protrusion press-fitting portions form a surface facing one of the pair of second opposed inner wall surfaces, and a surface facing the other second opposed inner wall surface approaches the other second opposed inner wall surface gradually toward the protruding direction. Thus, the clearance with the terminal press-fitting arrangement portion can be reduced in the direction in which the pair of second opposed inner wall surfaces are opposed to each other. In addition, the areas of the surfaces contacting with the pair of second opposed inner wall surfaces respectively can be suppressed to be small. As a result, the terminal hardly interferes with the inner wall surfaces of the terminal press-fitting arrangement portion when the terminal is pressed into the terminal press-fitting arrangement portion. Thus, looseness of the terminal in the connector housing can be suppressed to be small in directions perpendicular to each other, so that stability in connection between the terminal and a fixing destination of the terminal can be improved. In addition, it is possible to prevent difficulty in pressing the terminal into the connector housing.

According to the connection mechanism of a flat circuit body and a connector according to the third aspect of the invention, of the press-fitting fixation portion, the part where the pair of protrusion press-fitting portions are formed can be shaped easily by bending.

According to the connection mechanism of a flat circuit body and a connector according to the fourth aspect of the invention, the pair of rotation preventing ribs protrude in opposite directions to each other on the opposite sides of the fixing fixture and to form parts of the bottom of the connector housing, so that the connecting area of the connector housing to the fixing destination of the connector housing can be enlarged on the opposite sides of the fixing fixture. Accordingly, the bottoms of the pair of rotation preventing ribs abut against the fixing destination to prevent the connector housing from rotating to the left and right rotation directions respectively when the connector housing is to rotate using the fixing fixture as a fulcrum. Even when each terminal is soldered with the fixing destination, solder in the terminal can be prevented from being damaged due to a load applied onto the terminal by the rotation of the connector housing. As a result, electric connection between the terminal and the fixing destination can be prevented from deteriorating.

BRIEF DESCRIPTION OF THE DRAWINGS

FIG. 8A is a perspective view in which FIG. 7 is observed from the mounting portion side of the terminal, FIG. 8C is a view in which FIG. 7 is observed from the press-fitting port side to the terminal press-fitting arrangement portion.

DETAILED DESCRIPTION

A preferred embodiment of a connector, and a connection mechanism of a flat circuit body and the connector according to the invention will be described below in detail with reference to the drawings.

Figure 1A:
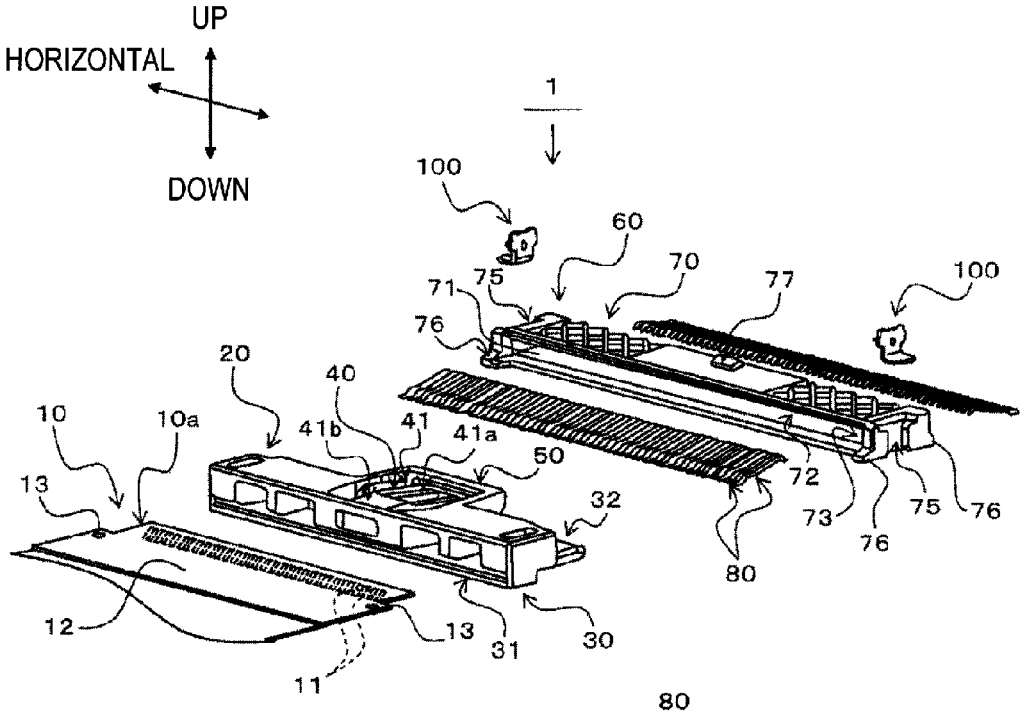
FIG. 1A is an exploded perspective view of a connection mechanism of a flat circuit body and a connector according to an embodiment of the invention.
Figure 1B:
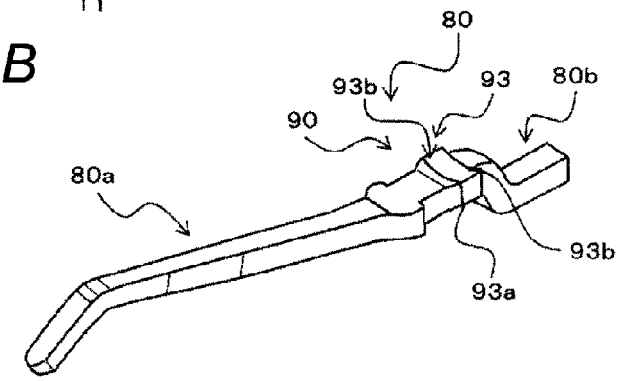
FIG. 1B is an enlarged perspective view of one of terminals shown in FIG. 1A.
Figure 2:
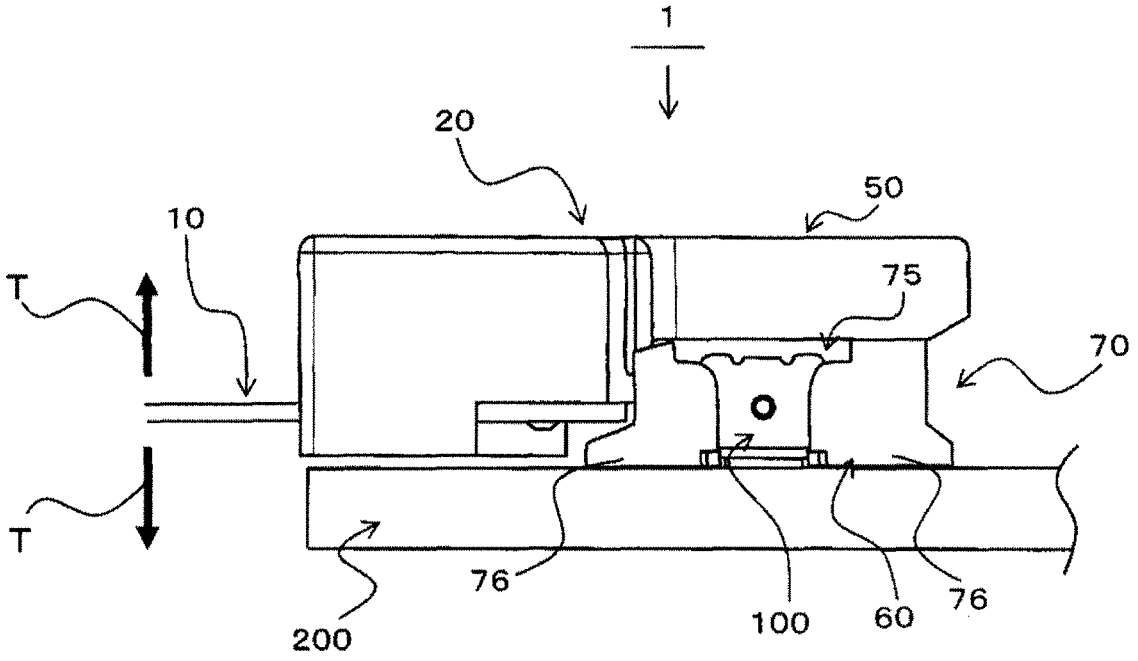
FIG. 2 is a side view of the flat circuit body and the connector in a state where electrodes and the terminals have been completely connected.
Figure 3A:
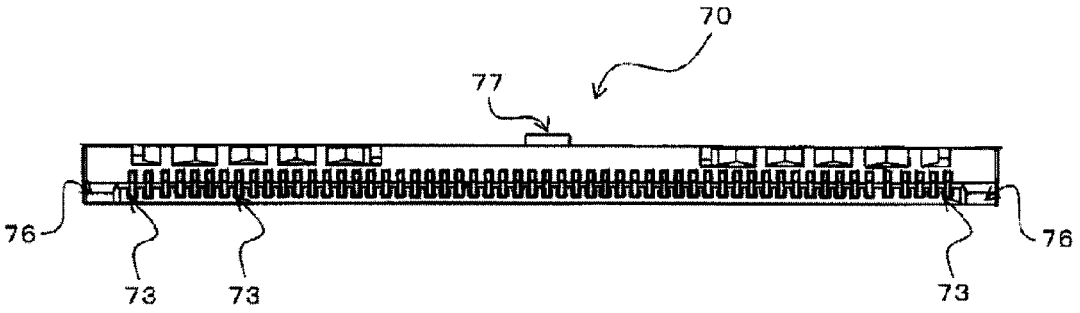
FIG. 3A is a view in which a connector housing is observed from the opposite side to the insertion side of the flat circuit body.
Figure 3B:
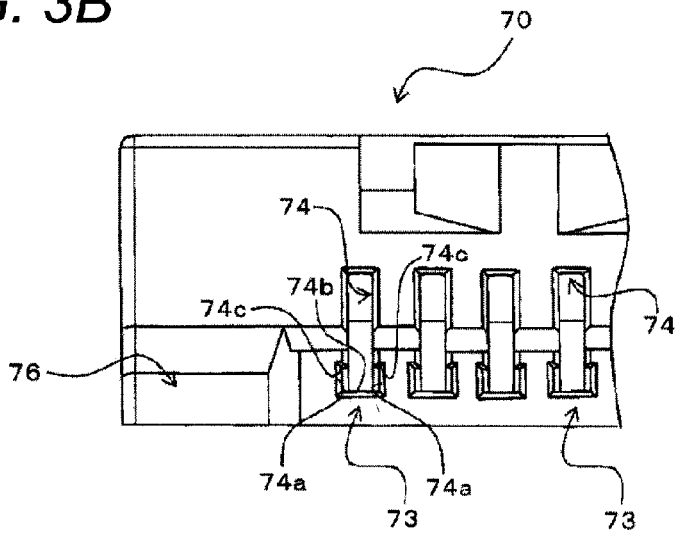
FIG. 3B is an enlarged view of the vicinities of terminal press-fitting arrangement portions in FIG. 3A.
Figure 4:
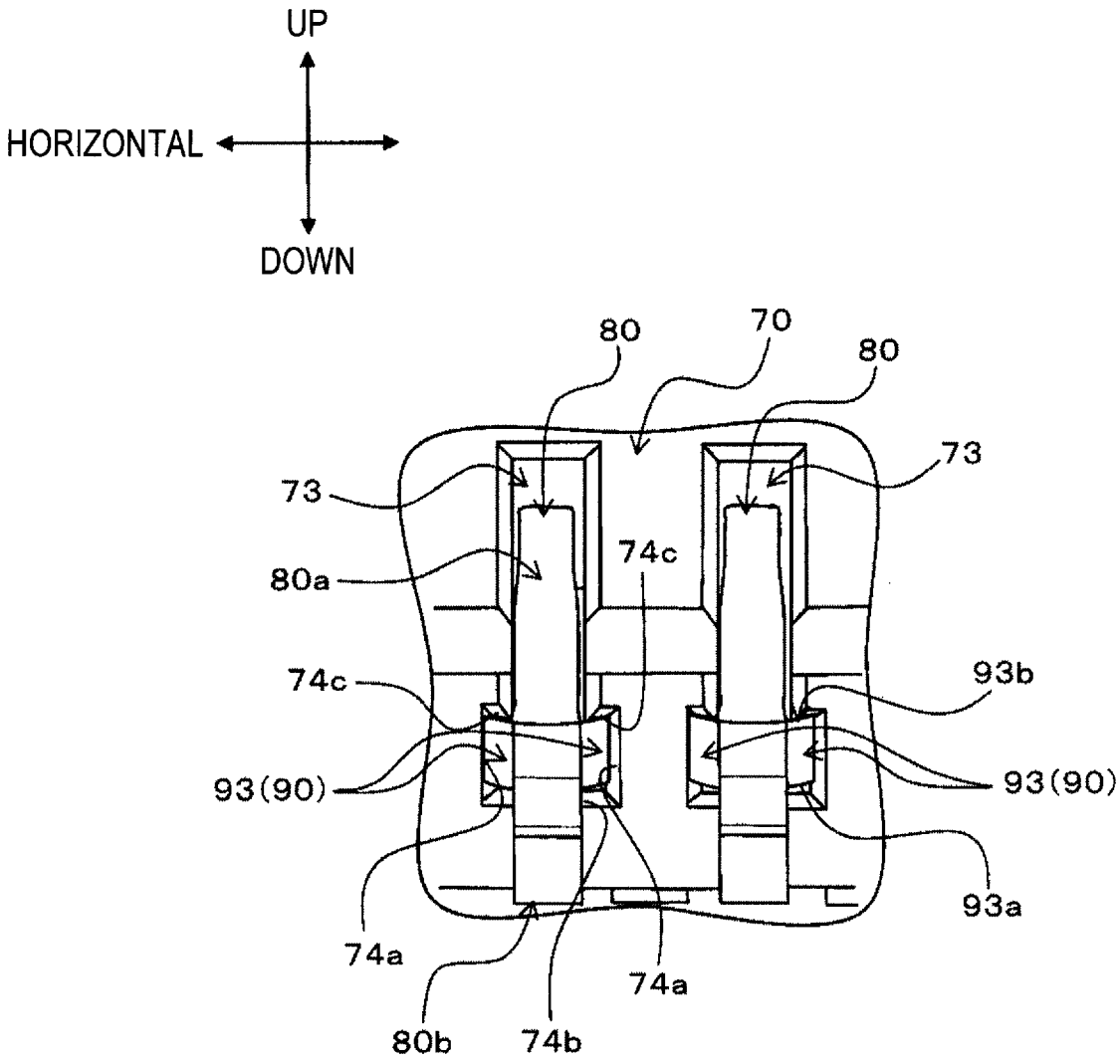
FIG. 4 is an enlarged view corresponding to FIG. 3B, showing the vicinities of the terminal press-fitting arrangement portions to which corresponding terminals have been pressed and fixed.
Figure 5:
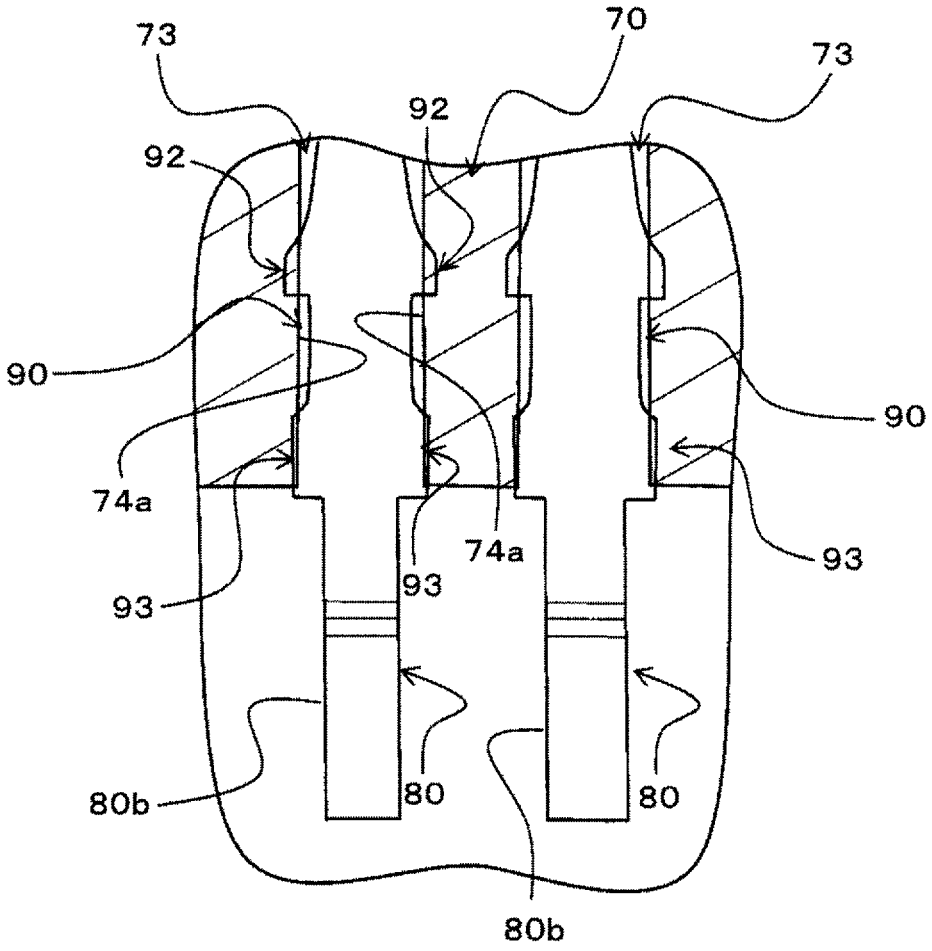
FIG. 5 is a cross-sectional view in which the connector has been cut horizontally, showing the vicinities of the terminal press-fitting arrangement portions.
Figure 6A:
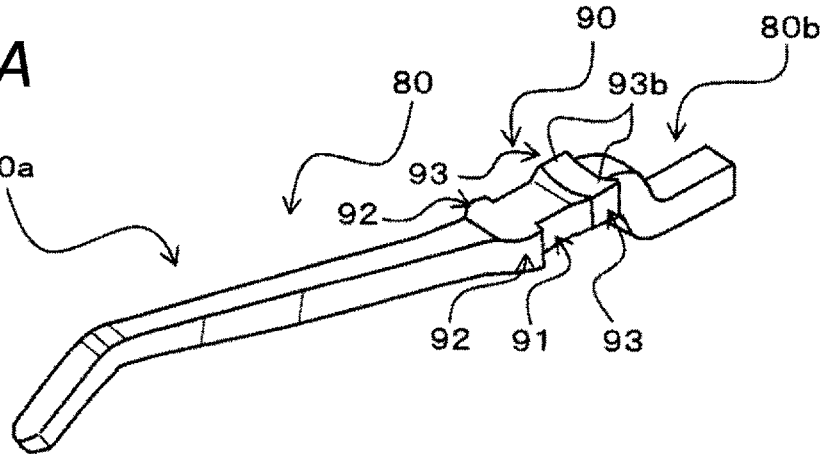
FIGS. 6A to 6C are views of a terminal observed from different directions respectively.
Figure 6B:
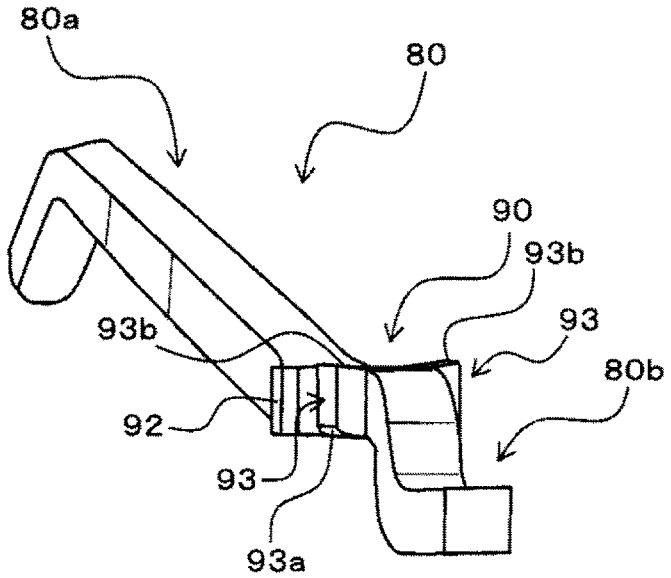
Figure 6C:
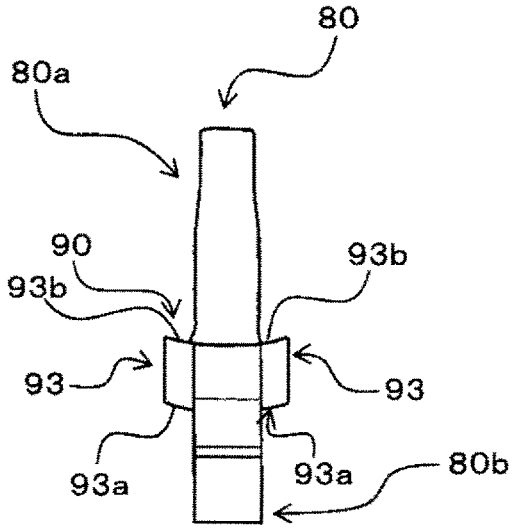

FIG. 1A is an exploded perspective view of a connection mechanism 1 of a flat circuit body and a connector according to an embodiment of the invention, and FIG. 1B is an enlarged perspective view of one of terminals 80 shown in FIG. 1A. FIG. 2 is a side view of a flat circuit body 10 and a connector 60 in a state where electrodes 11 and the terminals 80 have been completely connected. FIG. 3A is a view in which a connector housing 70 is observed from the opposite side to the insertion side of the flat circuit body 10, and FIG. 3B is an enlarged view of the vicinities of terminal press-fitting arrangement portions 73 in FIG. 3A. FIG. 4 is an enlarged view corresponding to FIG. 3B, showing the vicinities of the terminal press-fitting arrangement portions 73 to which corresponding terminals 80 have been pressed and fixed. FIG. 5 is a cross-sectional view in which the connector 60 has been cut horizontally, showing the vicinities of the terminal press-fitting arrangement portions 73. FIGS. 6 are views of a terminal 80 observed from different directions respectively.

In the connection mechanism 1 of a flat circuit body and a connector according to the embodiment of the invention, an end portion 10*a* of the flat circuit body 10 is inserted into the connector housing 70 of the connector 60 while sliding thereon. Thus, the electrodes 11 formed in the end portion 10*a* can be connected to the terminals 80 pressed and fixed into the connector housing 70.

Incidentally, in the embodiment of the invention, for the sake of convenience for explanation, up/down and horizontal directions are defined by the arrows in the drawings, and the horizontal direction corresponds to a protruding direction of a pair of protrusion press-fitting portions 93 and 93 while the up/down direction corresponds to a direction perpendicular to the protruding direction of the pair of protrusion press-fitting portions 93 and 93. However, the directions are not limited thereto. For example, the horizontal direction may be set as the direction perpendicular to the protruding direction of the pair of protrusion press-fitting portions 93 and 93.

First, the flat circuit body 10 will be described.

The flat circuit body 10 is, for example, implemented by a flexible printed circuit. The flat circuit body 10 is a flat flexible circuit board in which circuit wiring is formed out of a conductive metal film on an insulating resin sheet, and the surface of the insulating resin sheet is covered with an insulating protective film to thereby protect the circuit wiring.

In addition, in the flat circuit body 10, a plurality of electrodes 11 are formed in parallel as circuit wiring on a lower surface of the end portion 10*a*. The insulating protective film is partially removed to expose connection surfaces of the respective electrodes 11. In this manner, the electrodes 11 exposed to the outside are connected to the terminals 80 provided in the connector 60 respectively.

In addition, in the flat circuit body 10, a reinforcing plate 12 is pasted to a surface on the opposite side to the side where the electrodes 11 are exposed. The reinforcing plate 12 is pasted to the end portion 10*a* of the flat circuit body 10 in order to reinforce the end portion 10*a*.

Further, in the flat circuit body 10, a pair of engagement holes 13 and 13 are formed in the end portion 10*a* so as to penetrate the flat circuit body 10. Each of the pair of engagement holes 13 and 13 can engage with a corresponding one of a pair of not-shown engagement protrusions provided in a slide guide member 20.

Next, the slide guide member 20 will be described.

The slide guide member 20 is made of an insulating resin material such as synthetic resin. The slide guide member 20 has a rectangular parallelepiped outline shape. The slide guide member 20 has a circuit body attachment portion 30, a connection lock portion 40, and an operating grip portion 50. The circuit body attachment portion 30 serves as a part that can be attached to the end portion 10*a* of the flat circuit body 10. The connection lock portion 40 serves as a part that can engage with a locking protrusion 77 of the connector housing 70 so as to fix the slide guide member 20 to the connector housing 70. The operating grip portion 50 serves as a part that can be gripped for insertion to the connector 60 while sliding thereon.

The circuit body attachment portion 30 has a circuit body fixing portion 31 and a housing insertion portion 32. In the circuit body fixing portion 31, a pair of not-shown engagement protrusions that can engage with the pair of engagement holes 13 and 13 of the flat circuit body 10 are formed. The circuit body fixing portion 31 holds and fixes the flat circuit body 10 from above and below while positioning the flat circuit body 10 with the pair of engagement protrusions. The housing insertion portion 32 serves as a part in which an upper surface of the circuit body fixing portion 31 protrudes to extend in the insertion direction relatively to the flat circuit body 10 so as to be inserted into the connector housing 70 together with the end portion 10*a* of the flat circuit body 10.

The connection lock portion 40 has a movable portion 41 that can move elastically like a seesaw with a fulcrum. The movable portion 41 has a lock arm portion 41*a* on the front end side and an unlocking portion 41*b* on the rear end side. The lock arm portion 41*a* can engage with the locking protrusion 77 of the connector housing 70. The unlocking portion 41*b* can release the lock arm portion 41*a* from engagement with the locking protrusion 77.

When the movable portion 41 is in an elastically neutral state, the connection lock portion 40 configured thus is located so that the lock arm portion 41*a* can engage with the locking protrusion 77. When the unlocking portion 41*b* is operated and pushed downward, an end portion of the lock arm portion 41*a* is tilted upward so that the lock arm portion 41*a* can be released from the engagement with the locking protrusion 77.

Next, the connector 60 will be described.

The connector 60 includes the connector housing 70, and a plurality of terminals 80 pressed and fixed into the connector housing 70. The connector housing 70 is fixed to a fixing destination such as a circuit board 200 by a pair of fixing fixtures 100.

The connector housing 70 is made of an insulating resin material such as synthetic resin. The connector housing 70 has an approximately rectangular parallelepiped outline shape.

The terminals 80 are fixed to the inside of the connector housing 70 by press fitting. The connector housing 70 engages with the slide guide member 20 through the locking protrusion 77 provided in the upper surface of the connector housing 70 in a position where the flat circuit body 10 has been completely inserted into the connector housing 70 through an insertion port 71 for inserting the end portion 10*a* of the flat circuit body 10. Thus, the connector housing 70 can fix the flat circuit body 10 in a state where the electrodes 11 have been connected to the terminals 80 respectively.

In addition, an insertion space 72 in which the end portion 10*a* can be inserted into the connector housing 70 through the insertion port 71 is formed inside the connector housing 70. Terminal press-fitting arrangement portions 73 for pressing and fixing the terminals 80 are provided in an array corresponding to the electrodes 11 so as to be located below the end portion 10*a* inserted into the insertion space 72.

Each terminal press-fitting arrangement portion 73 forms inner wall surfaces 74 opposed to each other in the up/down direction and in the horizontal direction on the opposite sides of a press-fitting fixation portion 90 of a corresponding terminal 80 so that the press-fitting fixation portion 90 can be fixed to the terminal press-fitting arrangement portion 73 by press fitting. The inner wall surfaces 74 opposed to each other in the horizontal direction will be referred to as first opposed inner wall surfaces 74*a* and 74*a*. On the other hand, the inner wall surfaces 74 opposed to each other in a direction substantially perpendicular to the first opposed inner wall surfaces 74*a* and 74*a* will be referred to as second opposed inner wall surfaces, the lower one of which will be referenced by the sign 74*b* and the upper one of which will be referenced by the sign 74*c* so that they can be distinguished.

In addition, fixture fixing portions 75 and 75 to which fixing fixtures 100 can be fitted and fixed respectively are provided in the longitudinally both side portions of the connector housing 70. The fixing fixtures 100 fixed to the fixture fixing portions 75 respectively are fixed to the circuit board 200 so that the connector housing 70 can be fixed to the circuit board 200 serving as a fixing destination.

In addition, pairs of rotation preventing ribs 76 and 76 are provided in the longitudinal end portions of the connector housing 70 respectively so that the connector housing 70 can be prevented from rotating with each fixing fixture 100 as a fulcrum relatively to the circuit board 200.

Each pair of rotation preventing ribs 76 and 76 are provided to protrude frontward and rearward on the opposite sides of a corresponding one of the fixing fixture 100 and to form parts of a bottom of the connector housing 70.

That is, the pair of rotation preventing ribs 76 and 76 protrude in opposite directions to each other on the opposite sides of the fixing fixture 100 and to form parts of the bottom of the connector housing 70, so that the connecting area of the connector housing 70 to the circuit board 200 serving as a fixing destination can be enlarged on the opposite sides of the fixing fixture 100. Accordingly, the bottoms of the pair of rotation preventing ribs abut against the circuit board 200 to prevent the connector housing 70 from rotating to the left and right rotation directions respectively when the connector housing 70 is to rotate using the fixing fixture 100 as a fulcrum.

Even when the flat circuit body 10 connected to the connector 60 is, for example, pulled in the up/down direction as shown by the arrows T in FIG. 2 so that a force to rotate the connector housing 70 with each fixing fixture 100 as a fulcrum acts on the connector housing 70, the bottoms of each pair of rotation preventing ribs 76 and 76 prevent the rotation of the connector housing 70. As a result, solder in each terminal 80 soldered with the circuit board 200 can be prevented from being damaged.

Incidentally, in the embodiment, the pairs of rotation preventing ribs 76 and 76 are provided to protrude forward and rearward in the longitudinally end portions of the connector housing 70 respectively by way of example. However, the rotation preventing ribs 76 are not limited thereto. At least a pair of rotation preventing ribs 76 and 76 may be provided to protrude in opposite directions to each other on the opposite sides of each fixing fixture 100 and to form parts of the bottom of the connector housing 70.

Each terminal 80 is formed into a predetermined shape out of a pin-like metal member by bending or the like. The terminal 80 includes an elastic contact piece portion 80*a* and a mounting portion 80*b*. The elastic contact piece portion 80*a* serves as a part extending like a slope toward a corresponding electrode 11 from a press-fitting fixation portion 90 to be pressed and fixed into a corresponding terminal press-fitting arrangement portion 73 in the connector housing 70, so as to elastically contact with the electrode 11. The mounting portion 80*b* serves as a part located on the opposite side to the elastic contact piece portion 80*a* with respect to the press-fitting fixation portion 90 so as to be mounted on a circuit board serving as a fixing destination of the connector housing 70.

The elastic contact piece portion 80*a* has a bent part that is bent into a V-shape so that the vicinity of the bent part can contact with the electrode 11. When the end portion 10*a* of the flat circuit body 10 is inserted into the connector housing 70 while sliding thereon, the elastic contact piece portion 80*a* is elastically bent downward due to a load applied from the end portion 10*a*. Thus, due to elastic restoration force, the elastic contact piece portion 80*a* can keep the contact state with the electrode 11.

The press-fitting fixation portion 90 includes a fixation body portion 91, a pair of first protrusion press-fitting portions 92 and 92, and a pair of second protrusion press-fitting portions 93 and 93. The fixation body portion 91 serves as a part continuously extending in the press-fitting direction between the elastic contact piece portion 80*a* and the mounting portion 80*b*. The pair of first protrusion press-fitting portions 92 and 92 and the pair of second protrusion press-fitting portions 93 and 93 are provided as a pair of protrusion press-fitting portions protruding from the both side portions of the fixation body portion 91 so as to be separated from each other in the extending direction of the fixation body portion 91.

The pair of first protrusion press-fitting portions 92 and 92 protrude horizontally from the both side portions of the fixation body portion 91 on the elastic contact piece portion 80*a* side in the extending direction of the fixation body portion 91. When the first protrusion press-fitting portions 92 and 92 abut against the horizontally opposed inner walls 74*a* and 74*a* of the terminal press-fitting arrangement portion 73 opposed to each other, the press-fitting fixation portion 90 can be pressed and fixed by the terminal press-fitting arrangement portion 73.

Thus, when the press-fitting fixation portion 90 is pressed into the terminal press-fitting arrangement portion 73, the pair of first protrusion press-fitting portion 92 and 92 can suppress horizontal looseness.

The pair of second protrusion press-fitting portions 93 and 93 protrude horizontally from the both side portions of the fixation body portion 91 on the mounting portion 80*b* side in the extending direction of the fixation body portion 91.

The pair of second protrusion press-fitting portions 93 and 93 that have been pressed and fixed into the terminal press-fitting arrangement portion 73 protrude horizontally from the both side portions of the fixation body portion 91 toward the first opposed inner wall surfaces 74*a* and 74*a* of the terminal press-fitting arrangement portion 73 respectively. Thus, the second protrusion press-fitting portions 93 and 93 abut against the first opposed inner wall surfaces 74*a* and 74*a* and form a first surface 93*a* and a second surface 93*b*. The first surface 93*a* is separated from one of the pair of second opposed inner wall surfaces 74*b* and 74*c*, that is, the second opposed inner wall surface 74*b* gradually toward the protruding direction from a side portion. The second surface 93*b* approaches the other second opposed inner wall surface 74*c* gradually toward the protruding direction from the side portion.

Incidentally, in the embodiment, of the part of the press-fitting fixation portion 90 where the pair of second protrusion press-fitting portions 93 and 93 are formed, a cross-section in the direction in which the pair of second protrusion press-fitting portions 93 and 93 protrude is formed into an approximately U-shape. Accordingly, the pair of second protrusion press-fitting portions 93 and 93 can be shaped easily by bending.

In the press-fitting fixation portion 90 configured thus, the pair of second protrusion press-fitting portions 93 and 93 of the press-fitting fixation portion 90 protrude laterally in opposite directions to each other so as to contact with the first opposed inner walls surfaces 74*a* and 74*a* respectively, while the part between the pair of second protrusion press-fitting portions 93 and 93 forms a surface facing one surface 74*b* of the pair of second opposed inner wall surfaces 74*b* and 74*c*, and the surface 93*b* facing the other surface 74*c* is made to approach the other second opposed inner wall surface 74*c* gradually toward the protruding direction. Thus, the clearance with the terminal press-fitting arrangement portion 73 can be reduced in the direction in which the pair of second opposed inner wall surfaces 74*b* and 74*c* are opposed to each other. In addition, the areas of the surfaces contacting with the pair of second opposed inner wall surfaces 74*b* and 74*c* can be suppressed to be small.

As a result, in the part of the press-fitting fixation portion 90 where the pair of second protrusion press-fitting portions 93 and 93 are formed, looseness can be suppressed in directions perpendicular to each other in the connector housing 70.

In addition, in the press-fitting fixation portion 90, the first surface 93*a* of the pair of second protrusion press-fitting portions 93 and 93 is formed to be separated upward from the lower inner wall surface 74*b* of the terminal press-fitting arrangement portion 73 gradually toward the protruding direction, and the upper surface 93*b* of the pair of second protrusion press-fitting portions 93 and 93 is formed to approach the upper inner wall surface 74*c* of the terminal press-fitting arrangement portion 73 gradually toward the protruding direction. Accordingly, the areas contacting with the lower inner wall surface 74*b* and the upper inner wall surface 74*c* of the terminal press-fitting arrangement portion 73 respectively can be suppressed to be small. Thus, when a terminal is pressed into a terminal press-fitting arrangement portion, the terminal hardly interferes with the inner wall surfaces of the terminal press-fitting arrangement portion.

The mounting portion 80*b* extends from the fixation body portion 91 in the opposite direction to the elastic contact piece portion 80*a* so as to be bent like a crank. An end portion of the mounting portion 80*b* formed on a line extending substantially in parallel with the fixation body portion 91 can be mounted on the circuit board 200 by soldering.

Next, the operation in which the end portion 10*a* of the flat circuit body 10 is inserted into the connector housing 70 while sliding there so that the terminals 80 can be connected to the electrodes 11 will be described with reference to FIG. 7 and FIGS. 8A to 8D.

Figure 7:
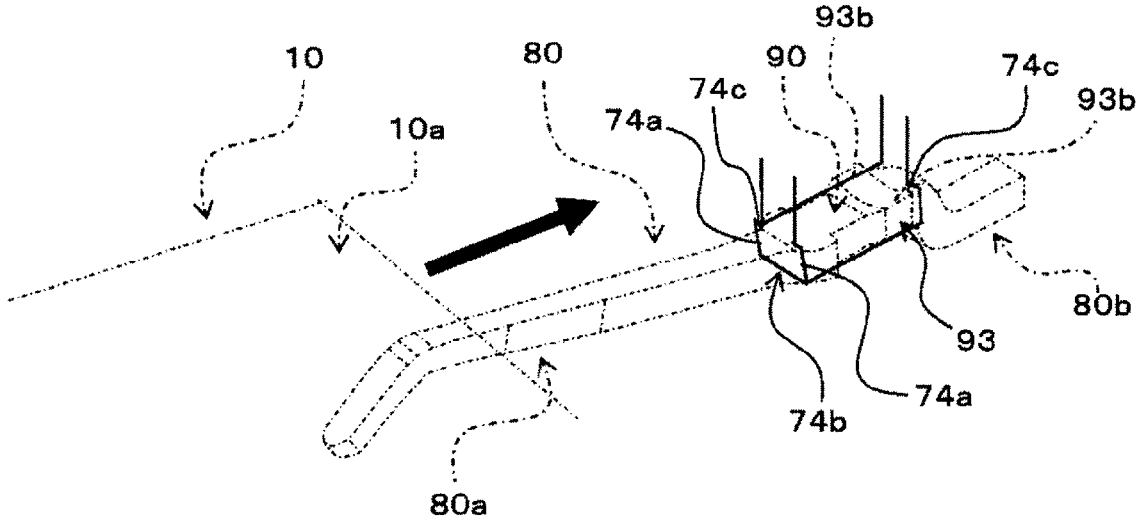
FIG. 7 is a view showing a state in which an end portion of the flat circuit body is being inserted into the connector housing while sliding thereon, the flat circuit body and the terminal being depicted by imaginary lines, the inner wall surfaces of the terminal press-fitting arrangement portion being depicted by solid lines.
Figure 8A:
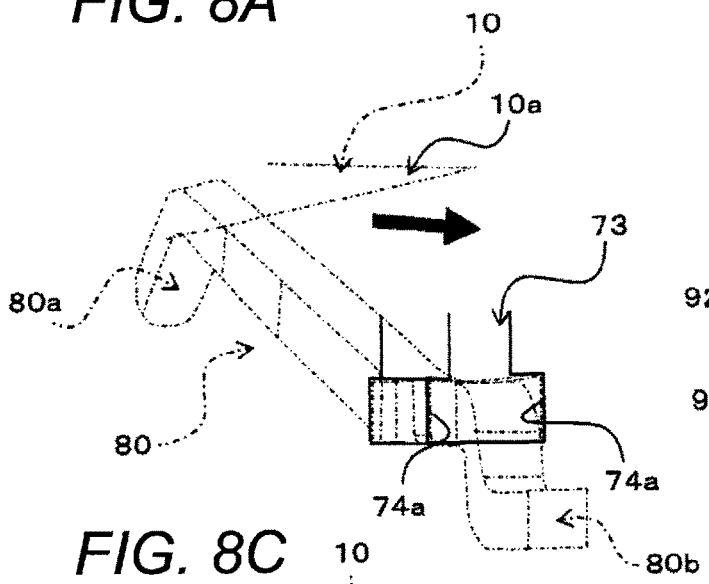
Figure 8B:
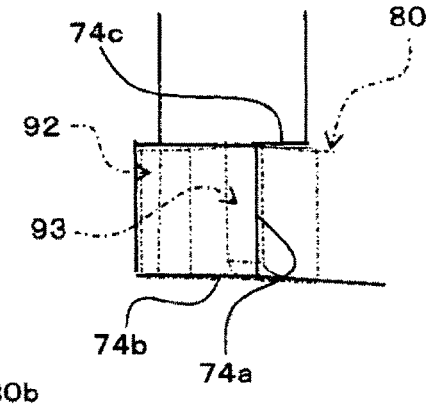
FIG. 8B is an enlarged view of the vicinity of one of a pair of second protrusion press-fitting portions.
Figure 8C:
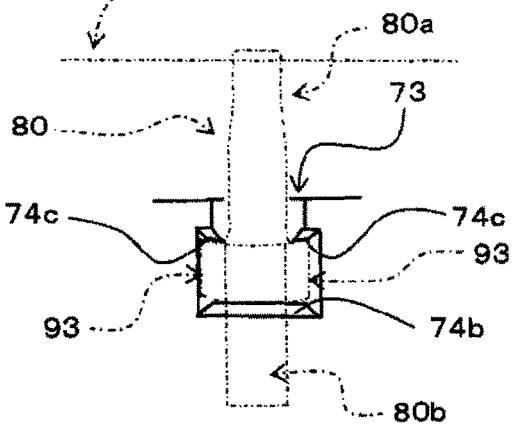
Figure 8D:
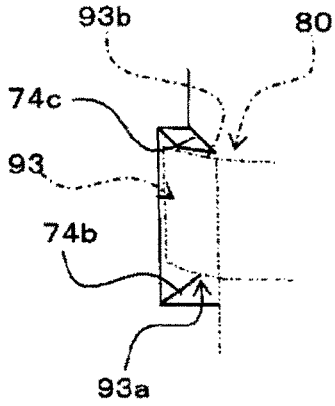
FIG. 8D is an enlarged view of the vicinity of one of the pair of second protrusion press-fitting portions.

FIG. 7 is a view showing a state in which the end portion 10*a* of the flat circuit body 10 is being inserted into the connector housing 70 while sliding thereon. In FIG. 7, the flat circuit body 10 and a terminal 80 being depicted by imaginary lines, and the inner wall surfaces 74 of a terminal press-fitting arrangement portion 73 are depicted by solid lines. FIG. 8A is a perspective view in which FIG. 7 is observed from the mounting portion 80*b* side of the terminal 80. FIG. 8B is an enlarged view of the vicinity of one of the pair of second protrusion press-fitting portions 93 and 93. FIG. 8C is a view in which FIG. 7 is observed from the press-fitting port side to the terminal press-fitting arrangement portion 73. FIG. 8D is an enlarged view of the vicinity of one of the pair of second protrusion press-fitting portions 93 and 93.

When the end portion 10*a* of the flat circuit body 10 is inserted into the connector housing 70 while sliding thereon, the end portion 10*a* contacts with the elastic contact piece portion 80*a* of each terminal 80 from above. Thus, a load acts on the terminal 80 so that the mounting portion 80*a* can be elastically bent downward.

As a result, the load operates to allow the mounting portion 80*b* to tilt upward with the press-fitting fixation portion 90 as a fulcrum. Since the pair of second protrusion press-fitting portions 93 and 93 form the upper surface 93*b* approaching the upper inner wall surface 74*c* of the terminal press-fitting arrangement portion 73 gradually toward the protruding direction, the press-fitting fixation portion 90 can approach the upper and lower inner surfaces 74*b* and 74*c* of the terminal press-fitting arrangement portion 73 as much as possible. Thus, looseness of the press-fitting fixation portion 90 in the terminal press-fitting arrangement portion 73 can be suppressed in the up/down direction.

According to the connection mechanism 1 of a flat circuit body and a connector according to the embodiment of the invention, in the press-fitting fixation portion 90, the pair of second protrusion press-fitting portions 93 and 93 protrude laterally in opposite directions to each other to thereby abut against the first opposed inner wall surfaces 74*a* and 74*a* respectively, while the part between the pair of second protrusion press-fitting portions 93 and 93 forms a surface facing one of the pair of second opposed inner wall surfaces 74*b* and 74*c*, that is, the surface 74*b*, and the surface 93*b* facing the other surface 74*c* approaches the other second opposed inner wall surface 74*c* gradually toward the protruding direction. Thus, the clearance with the terminal press-fitting arrangement portion 73 can be reduced in the direction in which the pair of second opposed inner wall surfaces 74*b* and 74*c* are opposed to each other. In addition, the areas of the surfaces contacting with the pair of second opposed inner wall surfaces 74*b* and 74*c* respectively can be reduced to be small. Accordingly, the terminal 80 hardly interferes with the inner wall surfaces 74 of the terminal press-fitting arrangement portion 73 when the terminal 80 is pressed into the terminal press-fitting arrangement portion 73. Thus, looseness of the terminal 80 in the connector housing 70 can be suppressed to be small in directions perpendicular to each other, to thereby improve stability in connection between the terminal 80 and the mounting destination of the terminal 80. In addition, it is possible to prevent difficulty in pressing the terminal 80 into the connector housing 70.

In addition, according to the connection mechanism 1 of a flat circuit body and a connector according to the embodiment of the invention, of the press-fitting fixation portion 90, the part where the pair of second protrusion press-fitting portions 93 and 93 are formed as a pair of protrusion press-fitting portions can be shaped easily by bending.

In addition, according to the connection mechanism 1 of a flat circuit body and a connector according to the embodiment of the invention, a pair of rotation preventing ribs 76 and 76 protrude in opposite directions to each other on the opposite sides of each fixing fixture 100, and form parts of the bottom of the connector housing 70, so that the area with which the connector housing 70 can be connected to the fixing destination can be enlarged on the opposite sides of the fixing fixture 100. Accordingly, the bottoms of the pair of rotation preventing ribs 76 and 76 abut against the fixing destination to prevent the connector housing 70 from rotating to the left and right rotation directions respectively when the connector housing 70 is to rotate using the fixing fixture 100 as a fulcrum. Even when each terminal 80 is soldered with the fixing destination, solder in the terminal 80 can be prevented from being damaged due to a load applied onto the terminal 80 by the rotation of the connector housing 70. As a result, electric connection between the terminal 80 and the fixing destination can be prevented from deteriorating.

Incidentally, in the connection mechanism 1 of a flat circuit body and a connector according to the embodiment of the invention, the pair of first protrusion press-fitting portions 92 and 92 and the pair of second protrusion press-fitting portions 93 and 93 are provided in the press-fitting fixation portion 90 as a pair of protrusion press-fitting portions protruding from the both side portions of the fixation body portion 91 by way of example. However, the invention is not limited thereto. It will go well if at least a pair of second protrusion press-fitting portions 93 and 93 are provided as the pair of protrusion press-fitting portions.

Modification

Next, a modification of each terminal in the connection mechanism 1 of a flat circuit body and a connector according to the embodiment of the invention will be described with reference to FIGS. 9A to 9C.

Figure 9A:
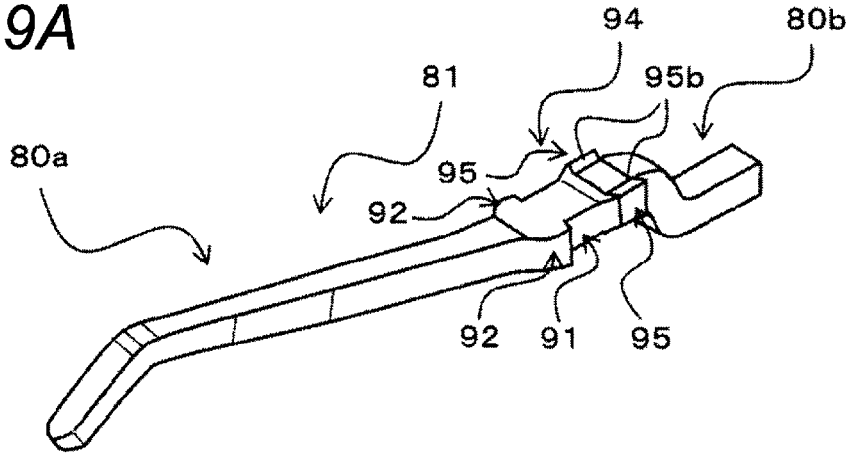
FIGS. 9A to 9C are views in which a terminal according to a modification is observed from different directions respectively.
Figure 9B:
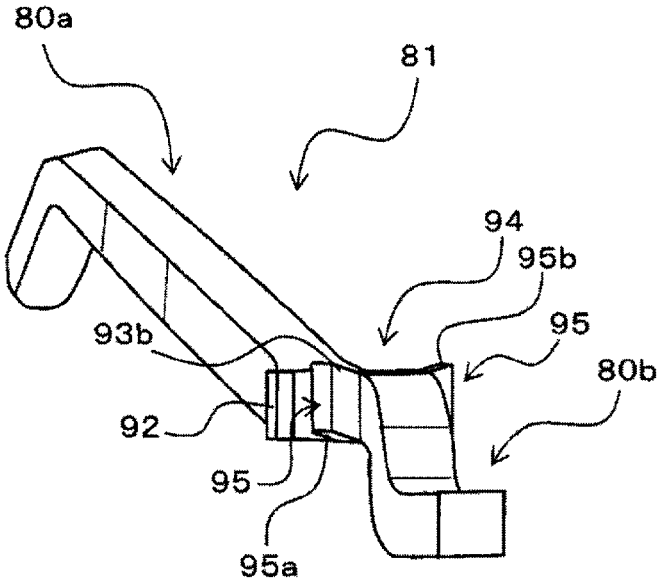
Figure 9C:
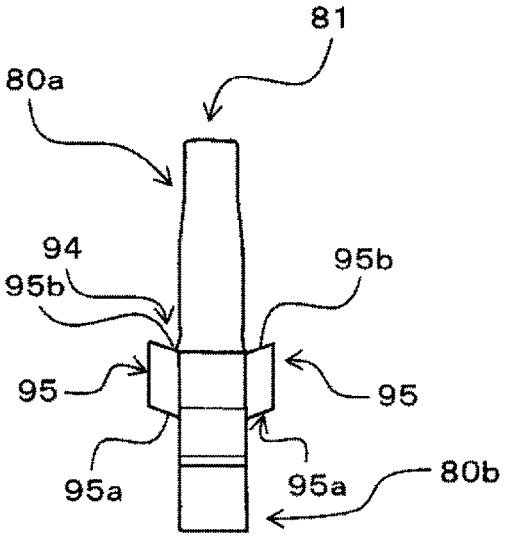
Figure 10A:
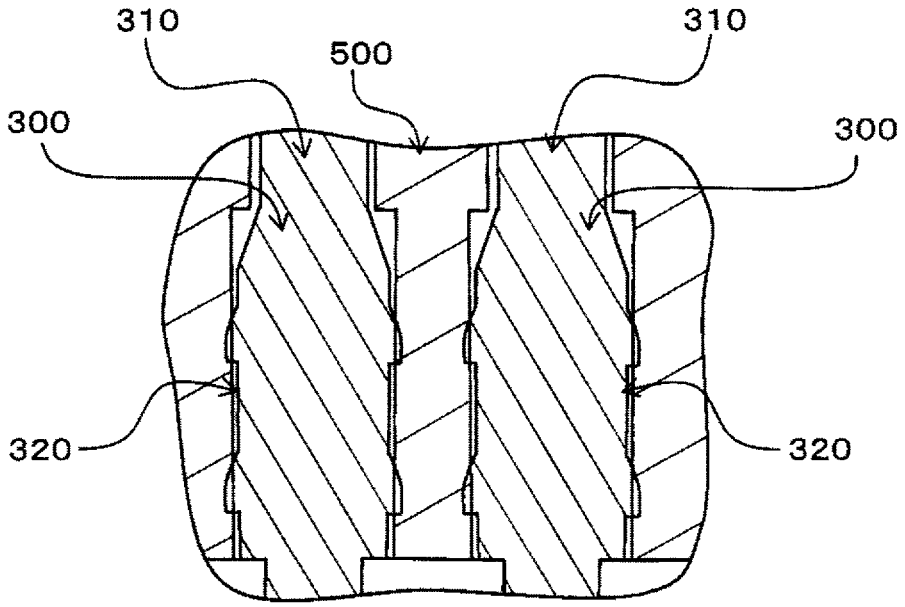
FIGS. 10A and 10B are views for explaining problems in the related art.
Figure 10B:
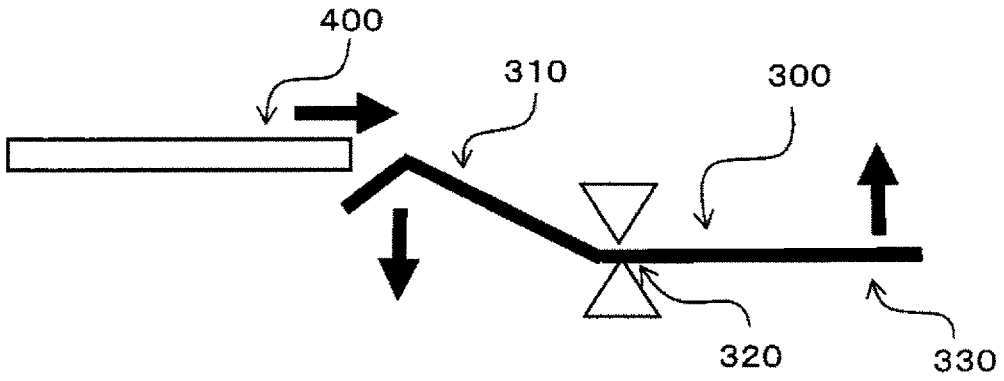

FIGS. 9A to 9C are views in which a terminal 81 according to the modification is observed from different directions respectively.

In the terminal 81 according to the modification, the shapes of a pair of second protrusion press-fitting portions 95 and 95 are different from those in the terminal according to the embodiment.

Incidentally, the other configuration is similar to that in the terminal according to the embodiment, and constituent parts the same as those in the embodiment are referenced correspondingly.

In the terminal 81 according to the modification, a pair of second protrusion press-fitting portions 95 and 95 protrude horizontally from the both side portions of the fixation body portion 91 on the mounting portion 80*b* side in the extending direction of the fixation body portion 91.

The pair of second protrusion press-fitting portions 95 and 95 that have been pressed and fixed into the terminal press-fitting arrangement portion 73 protrude horizontally from the both side portions of the fixation body portion 91 toward the first opposed inner wall surfaces 74*a* and 74*a* of the terminal press-fitting arrangement portion 73 respectively so as to abut against the first opposed inner wall surfaces 74 and 74*a*, and to form a first surface 95*a* and a second surface 95*b*. The first surface 95*a* is separated from one of the pair of second opposed inner wall surfaces 74*b* and 74*c* of the terminal press-fitting arrangement portion 73 opposed to each other in a direction substantially perpendicular to the pair of first opposed inner wall surfaces 74 a and 74*a*, that is, the second opposed inner wall surface 74*b* gradually toward the protruding direction from a side portion. The second surface 95*b* approaches the other second opposed inner wall surface 74*c* gradually toward the protruding direction from the side portion.

Incidentally, the first surface 95*a* and the second surface 95*b* of the pair of second protrusion press-fitting portions 95 and 95 are slopes.

The invention developed by the inventor has been described above specifically based on the aforementioned embodiment of the invention. The invention is not limited to the aforementioned embodiment, but various changes can be made thereon without departing from the gist thereof

What is claimed is:

1. A connector comprising:

a connector housing which comprises a terminal press-fitting arrangement portion and to which a flat circuit body comprising an electrode formed in an end portion thereof is allowed to be slidably inserted; and a terminal which is provided in the connector housing and which is connected to the electrode when the end portion is inserted into the connector housing, wherein the terminal comprises:

a press-fitting fixation portion which is pressed and fixed into the terminal press-fitting arrangement portion;

an elastic contact piece portion which extends like a slope from the press-fitting fixation portion toward the electrode so as to serve as a part elastically contacting with the electrode; and a mounting portion which is provided on an opposite side to the elastic contact piece portion with respect to the press-fitting fixation portion so as to serve as a part which is mountable on a fixing destination of the connector housing, wherein the press-fitting fixation portion comprises a pair of protrusion press-fitting portions which protrude in protruding directions from both side portions of a fixation body portion which continuously extend between the elastic contact piece portion and the mounting portion along a press-fitting direction, wherein the terminal press-fitting arrangement portion comprises:

a pair of first opposed inner wall surfaces which are opposed to each other at lateral sides of the fixation body portion in a state where the press-fitting fixation portion is pressed and fixed; and a pair of second opposed inner wall surfaces which are opposed to each other in a direction substantially perpendicular to the first opposed inner wall surfaces, and wherein in a state where the protrusion press-fitting portions are pressed and fixed into the terminal press-fitting arrangement portion, the protrusion press-fitting portions protrude from the both side portions of the fixation body portion toward the first opposed inner wall surfaces, respectively, so as to abut against the pair of first opposed inner wall surfaces, and each of the protrusion press-fitting portions comprises a first surface gradually separated from one of the pair of second opposed inner wall surfaces toward the protruding direction, and a second surface gradually approaching the other of the pair of second opposed inner wall surfaces toward the protruding direction.

2. A connection mechanism of a flat circuit body and a connector, the connection mechanism comprising:

a flat circuit body comprising an electrode formed in an end portion thereof; and a connector comprising:

a connector housing which comprises a terminal press-fitting arrangement portion and to which the flat circuit body is allowed to be slidably inserted; and a terminal which is provided in the connector housing and which is connected to the electrode when the end portion is inserted into the connector housing, wherein the terminal comprises:

a press-fitting fixation portion which is pressed and fixed into the terminal press-fitting arrangement portion;

an elastic contact piece portion which extends like a slope from the press-fitting fixation portion toward the electrode so as to serve as a part elastically contacting with the electrode; and a mounting portion which is provided on an opposite side to the elastic contact piece portion with respect to the press-fitting fixation portion so as to serve as a part which is mountable on a fixing destination of the connector housing, wherein the press-fitting fixation portion comprises a pair of protrusion press-fitting portions which protrude in protruding directions from both side portions of a fixation body portion which continuously extend between the elastic contact piece portion and the mounting portion along a press-fitting direction, wherein the terminal press-fitting arrangement portion comprises:

a pair of first opposed inner wall surfaces which are opposed to each other at lateral sides of the fixation body portion in a state where the press-fitting fixation portion is pressed and fixed; and a pair of second opposed inner wall surfaces which are opposed to each other in a direction substantially perpendicular to the first opposed inner wall surfaces, and wherein in a state where the protrusion press-fitting portions are pressed and fixed into the terminal press-fitting arrangement portion, the protrusion press-fitting portions protrude from the both side portions of the fixation body portion toward the first opposed inner wall surfaces, respectively, so as to abut against the pair of first opposed inner wall surfaces, and each of the protrusion press-fitting portions comprises a first surface gradually separated from one of the pair of second opposed inner wall surfaces toward the protruding direction, and a second surface gradually approaching the other of the pair of second opposed inner wall surfaces toward the protruding direction.

3. The connection mechanism of a flat circuit body and a connector according to claim 2, wherein the press-fitting fixation portion has a substantially U-shaped cross-sectional shape at a part where the pair of protrusion press-fitting portions are formed.

4. The connection mechanism of a flat circuit body and a connector according to claim 2, wherein the connector housing comprises at least a pair of rotation preventing ribs which are fixed to a fixing destination of the connector housing by a fixing fixture, which protrude in opposite directions to each other with respect to the fixing fixture placed therebetween, and which form part of a bottom surface of the connector housing.

* * * * *